US007373974B2

(12) United States Patent
Connell et al.

(10) Patent No.: US 7,373,974 B2
(45) Date of Patent: May 20, 2008

(54) DOWNHOLE RELEASE TOOL AND METHOD

(75) Inventors: Michael L. Connell, Duncan, OK (US); James C. Tucker, Springer, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 264 days.

(21) Appl. No.: 11/001,171

(22) Filed: Nov. 30, 2004

(65) Prior Publication Data

US 2006/0113083 A1 Jun. 1, 2006

(51) Int. Cl.
*E21B 17/00* (2006.01)

(52) U.S. Cl. ..... 166/242.6; 166/377; 166/242.1; 166/383

(58) Field of Classification Search ..... 166/377, 166/242.1, 424.6, 383, 242.6
See application file for complete search history.

(56) References Cited

U.S. PATENT DOCUMENTS 5,146,984 A 9/1992 Pleasants ..... 166/238
5,507,349 A 4/1996 Wray et al. ..... 166/382
5,561,278 A 10/1996 Rutten ..... 200/5 A
5,718,291 A * 2/1998 Lorgen et al. ..... 166/377
5,984,029 A * 11/1999 Griffin et al. ..... 175/321
6,131,953 A 10/2000 Connell et al. ..... 285/3
6,269,883 B1 * 8/2001 Gissler et al. ..... 166/340
6,766,853 B2 7/2004 Restarick et al. ..... 166/242.3
2001/0030048 A1 10/2001 Mackenzie et al. ..... 166/380
2003/0102132 A1 6/2003 Estep et al. ..... 166/377
2004/0045704 A1 3/2004 Bowles ..... 166/242.7
2004/0055757 A1 3/2004 Beall ..... 166/382

* cited by examiner

*Primary Examiner*—David J. Bagnell
*Assistant Examiner*—Brad Harcourt
(74) *Attorney, Agent, or Firm*—John W. Wustenberg; Fish & Richardson P.C.

(57) ABSTRACT

A release tool includes a first subassembly and a second subassembly. A connector is operable to selectively coupled the first subassembly to the second subassembly. A release guard is operable to selectively inhibit release of the connector. The release guard operable to inhibit release of the connector in response to a pressure difference between an interior of the release tool and an exterior of the release tool.

32 Claims, 3 Drawing Sheets

DOWNHOLE RELEASE TOOL AND METHOD

TECHNICAL FIELD

This disclosure relates generally to the field of downhole tools, more particularly to a downhole release tool and method.

BACKGROUND

Coiled tubing is often used for drilling and servicing oil and gas wells. Coiled tubing is flexible, small-diameter continuous steel tubing. In drilling operations, coiled tubing may be used for drilling wells that deviate from vertical. The coiled tubing conveys drilling fluid to a downhole drilling motor that drives a drill bit for drilling. In servicing operations, coiled tubing may be used for logging, cleaning, initiating flow, well simulation, and cementing. Coiled tubing generally reduces trip time compared to jointed tubing.

Several types of emergency releases have been used for disconnecting a stuck downhole tool from coiled tubing. For example, shear disconnects, hydraulic disconnects and electrical disconnects have been used. Such disconnects typically include upper and lower sections with seals to prevent leakage.

Shear connects use shear pins or screws that hold the sections together. In the event the downhole tool becomes stuck in the well, the coiled tubing is pulled with sufficient tension to break the cumulative shear pin's strength. Hydraulic disconnects are typically ball-activated release devices. Hydraulic disconnects are capable of holding high tension and pressure because they are pressure-balanced. Electrical disconnects release the downhole tool from the coiled tubing by applying an electrical signal through a wire to the release device.

SUMMARY

A downhole release tool and method are provided. In accordance with one embodiment, a release tool includes a first subassembly and a second subassembly. A connector is operable to selectively couple the first subassembly to the second subassembly. A release guard is operable to selectively inhibit release of the connector.

In accordance with one or more specific embodiments, the release guard may be operable to inhibit release of the connector by blocking release movement of the connector. For example, the release guard may be biased to allow release movement of the connector and moveable to block the release movement of the connector. A release guard may be moveable in response to at least one downhole condition. The downhole condition may be a downhole pressure or other condition.

Technical advantages of one, some, all or none of the embodiments may include a downhole release tool that reduces or eliminates accidental release while allowing release at a relatively low parting force. For example, release is inhibited at a first downhole condition, such as during a downhole well operation. Accordingly, large coiled tubing or other units need not be deployed for a job.

Another technical advantage of one, some, all or none of the embodiments is a downhole release tool with a release mechanism that is not dependent on circulation or electrical signals. For example, release may be selectively allowed or inhibited in response to a downhole pressure condition. Accordingly, a stuck downhole tool may be released in the event of a screen-out. In addition, fracturing and other operations requiring high flow rates of sand-laden fluids can be performed without damage to the release mechanism.

The details of one or more embodiments of the downhole release tool are set forth in the accompanying drawings and the description below. Other features, objects, and advantages of the downhole release tool will be apparent from the description and drawings, and from the claims.

DESCRIPTION OF DRAWINGS

Like reference symbols in the various drawings indicate like elements.

DETAILED DESCRIPTION

Figure 1:
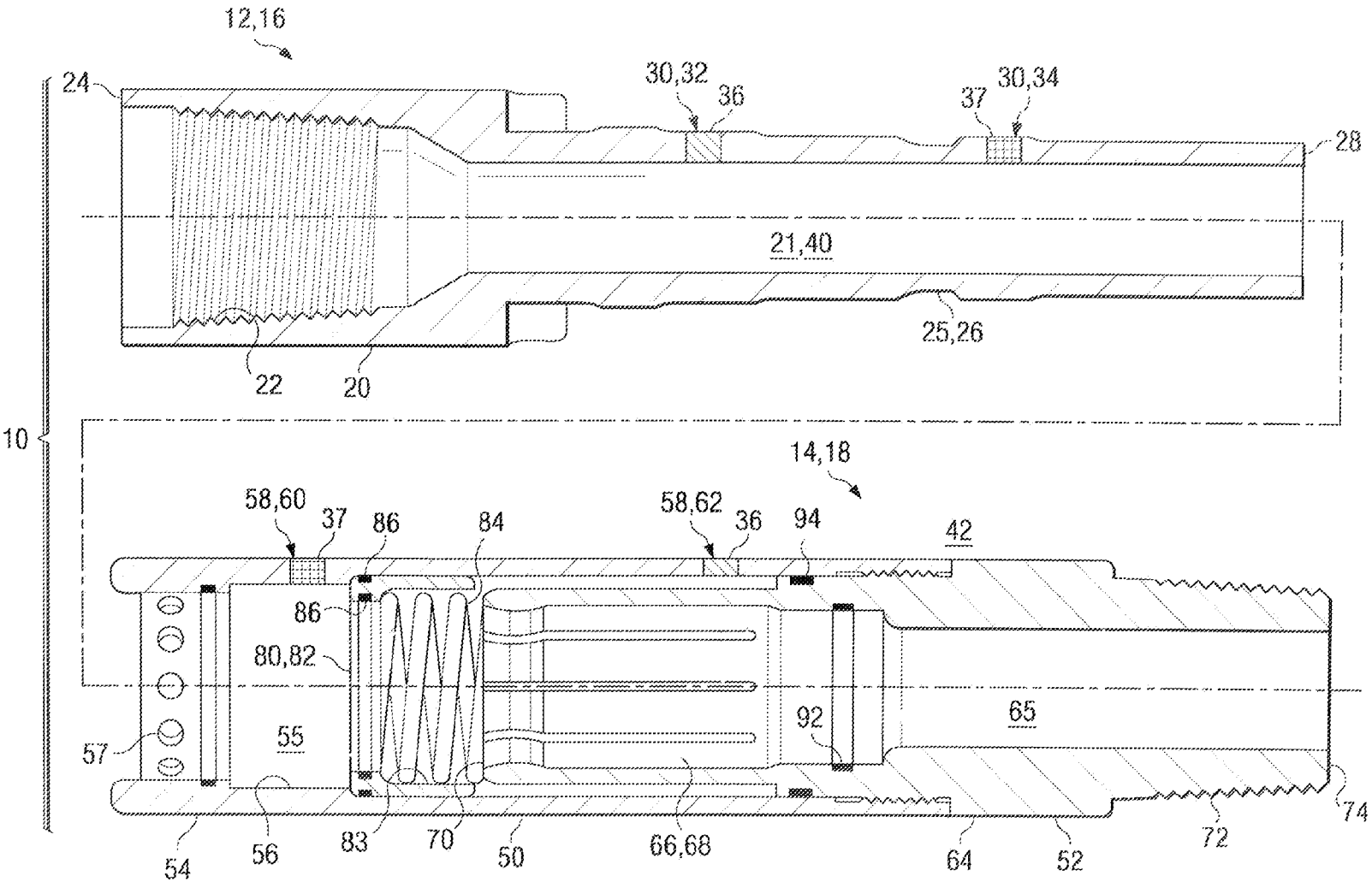
FIG. 1 is a cross-sectional view illustrating one embodiment of a release tool with upper and lower subassemblies disconnected.

FIG. 1 illustrates a downhole release tool 10 in accordance with one embodiment. In this embodiment, the downhole release tool 10 comprises a first subassembly 12 and a second subassembly 14. The first subassembly 12 may be an upper subassembly 16 configured to connect to a tubing string. The tubing string may be coiled tubing, jointed pipe or other tubular coupling the downhole release tool 10 to a rig or other surface unit. The second subassembly 14 may be a lower subassembly 18 configured to connect to a downhole tool. As described in more detail below, the downhole tool may be a fracture or other tool for completing and/or servicing an oil, gas or other well.

Referring to FIG. 1, the upper subassembly 16 comprises an elongated cylindrical body 20 defining an interior passageway 21. An internal thread 22 is machined or otherwise formed at an upper end 24 of the cylindrical body 20 for attachment to a coiled tubing or other suitable connector. A receiver 25 is machined or otherwise formed on an outer diameter of the cylindrical body 20 toward the lower end 28 of the cylindrical body 20. The receiver 25 may comprise a groove 26 or other configuration operable to receive and retain a mating protuberance 66 of the lower subassembly 18. The protuberance 66 is described in more detail below and may, for example, comprise collet fingers 68.

Upper subassembly equalizing vent ports 30 may be drilled or otherwise formed in cylindrical body 20. Upper subassembly equalizing vent ports 30 may when open communicate pressure and/or fluid between interior passageway 21 or other portion of an interior 40 of the downhole release tool 10 and an exterior 42 of the downhole release tool 10. In a particular embodiment, upper subassembly equalizing vent ports 30 may comprise a first upper subassembly vent port 32 and a second upper subassembly vent port 34. The first and second upper subassembly vent ports 32 and 34 may in a particular embodiment each be one-quarter (¼) to three-eighths (⅜) inches in diameter. Depending on a downhole well operation, a plug 36 may be used in one or both of first and second upper subassembly vent ports 32 and 34. A screen or filter 37 may be disposed in unplugged ones of the first and second upper subassembly vent ports 32 and 34 for fracture and other operations using sand-laden fluids.

The lower subassembly 18 may comprise a fishneck subassembly 50 and a bottom subassembly 52. The fishneck subassembly 50 may be threaded or otherwise coupled to the bottom subassembly 52. In another embodiment, the fishneck subassembly 50 may be integral with the bottom subassembly 52 or may be omitted.

The fishneck subassembly 50 comprises an elongated cylindrical body 54 defining an interior passageway 55. The cylindrical body 54 may include an interior fishneck 56. A plurality of shear pin holes 57, which may be tapped, smooth or otherwise, for connecting the lower subassembly 18 to the upper subassembly 16 with shear pins are drilled or otherwise formed in cylindrical body 54. The shear pins may comprise pins, screws or other shearable fasteners.

Lower subassembly equalizing vent ports 58 may be machined or otherwise formed in cylindrical body 54. Lower subassembly equalizing vent ports 58 may when open communicate pressure and/or fluid between the interior 40 and the exterior 42 of the downhole release tool 10. In a particular embodiment, lower subassembly equalizing vent ports 58 may include a first lower subassembly vent port 60 and a second lower subassembly vent port 62. The first and second lower subassembly vent ports 60 and 62 may be sized, include a plug 36 and/or include a screen 37 as described in connection with first and second upper subassembly vent ports 32 and 34. In a specific embodiment described in more detail below, pressure may be communicated between the interior 40 and the exterior 42 of the downhole release tool 10 through a set of upper subassembly equalizing vent ports 30 and lower subassembly equalizing vent ports 58.

Bottom subassembly 52 comprises an elongated cylindrical body 64 defining an interior passageway 65. One or more protuberances 66 may extend from cylindrical body 64. In one embodiment, the protuberances 66 may comprise collet fingers 68 configured to mate with corresponding groove 26. Collet fingers 68 may encircle an upper end 70 of bottom subassembly 52 and, when the upper and lower subassemblies 16 and 18 are engaged, encircle groove 26. In this embodiment, collet fingers 68 may deflect outward to release from groove 26. Suitable space for this release movement is provided between the outer diameter of collet fingers 68 and the facing inner diameter of fishneck subassembly 50.

External threads 72 may be machined or otherwise formed at a lower end 74 of bottom subassembly 52. External threads 72 may be configured to couple to one or more downhole tools. As previously described, the downhole tools may comprise a downhole fracture or other tool for a downhole well operation.

Collet fingers 68 and groove 26, or other mating pieces from the upper and lower subassemblies 16 and 18, together form a connector operable to couple the lower subassembly 18 to the upper subassembly 16. Other reusable connectors operable to selectively couple the lower subassembly 18 to the upper subassembly 16 may be used. For example, lugs may be used. Where shear pins are used, the shear pins comprise a secondary, but non-reusable connector.

A release guard 80 is provided in the lower subassembly 18 to selectively inhibit release of the connector between the upper subassembly 16 and the lower subassembly 18. The release guard 80 inhibits release of the connector by preventing, blocking, restricting, limiting, restraining or interfering with release of the connector. In the collet finger 68 embodiment, the release guard 80 may comprise a floating piston 82 with a skirt 83 disposed in the fishneck 56. In this embodiment, the floating piston 82 with skirt 83 is moveable to encircle collet fingers 68 and block the outward release movement of the collet fingers 68. The floating piston 82 or other release guard 80 may otherwise inhibit release of the connector. For example, the release guard 80 may deflect, turn, otherwise slide, inflate or deflate to selectively inhibit release of the connector.

The floating piston 82 may be biased to allow release movement of the collet fingers 68 in a first downhole condition and moveable to block release movement of the collet fingers 68 in a second downhole condition. As described in more detail below in connection with FIG. 2, the first downhole condition may comprise an equalized pressure between the interior 40 and the exterior 42 of the downhole release tool 10. The second downhole condition may comprise a pressure difference between the interior 40 and exterior 42 of the downhole release tool 10. The pressure difference may comprise a minimal pressure difference necessary to overcome the biasing force acting on floating piston 82. In this embodiment, the equalized pressure may be any pressure differential less than the minimal pressure. The floating piston 82 may be biased with a spring 84, compressed gas or otherwise. Seals 86 may be included on the internal diameter and external diameter of the floating piston 82.

Lower subassembly 18, including fishneck subassembly 50 and bottom subassembly 52, is internally configured to receive a lower portion of the cylindrical body 20 of upper subassembly 16. Seals 92 may be provided in the interior passageway 65 of the bottom subassembly 52 to seal the outer diameter of the upper subassembly 16 to the inner diameter of the lower subassembly 18. Seals 94 may be provided between the fishneck subassembly 50 and bottom subassembly 52 to seal the inner diameter of the fishneck subassembly 50 to the outer diameter of the bottom subassembly 52.

One or more keys (not shown) may extend from the lower subassembly 18 into a corresponding slot of upper subassembly 16 to hold torque between the upper subassembly 16 and the lower subassembly 18 and thus confine the parting force to separate the upper subassembly 16 from the lower subassembly 18 to a shear force. In one embodiment, the shear force for separating the upper subassembly 16 from the lower subassembly 18 may be less than 20,000 pounds where the release guard 80 is disengaged and may be greater than 50,000 or even 100,000 pounds when the release guard 80 is engaged.

In a specific embodiment, six 3000-pound shear pins may be used in connection with the collet fingers 68. In this embodiment, the downhole release tool 10 may have a parting force when the release guard 80 is disengaged of approximately 18,700 pounds, 18,000 pounds from the shear pins and 700 pounds from the collet fingers 68. In this embodiment, when the release guard 80 is engaged, the parting force may be at least 100,000 pounds. Thus, for example, downhole well operations may be carried out without accidental release of the downhole release tool 10 by maintaining engagement of the release guard 80 during all or part of the downhole well operation. In this example, release of the downhole release tool 10 may be performed with a low parting force of 40,000, 30,000, 25,000, 20,000 or less pounds force. The upper subassembly 16, lower subassembly 18, floating piston 82 and spring 84 may each comprise stainless steel or other suitable material. The plugs 36 may comprise, for example, stainless or other steel.

Figure 2:
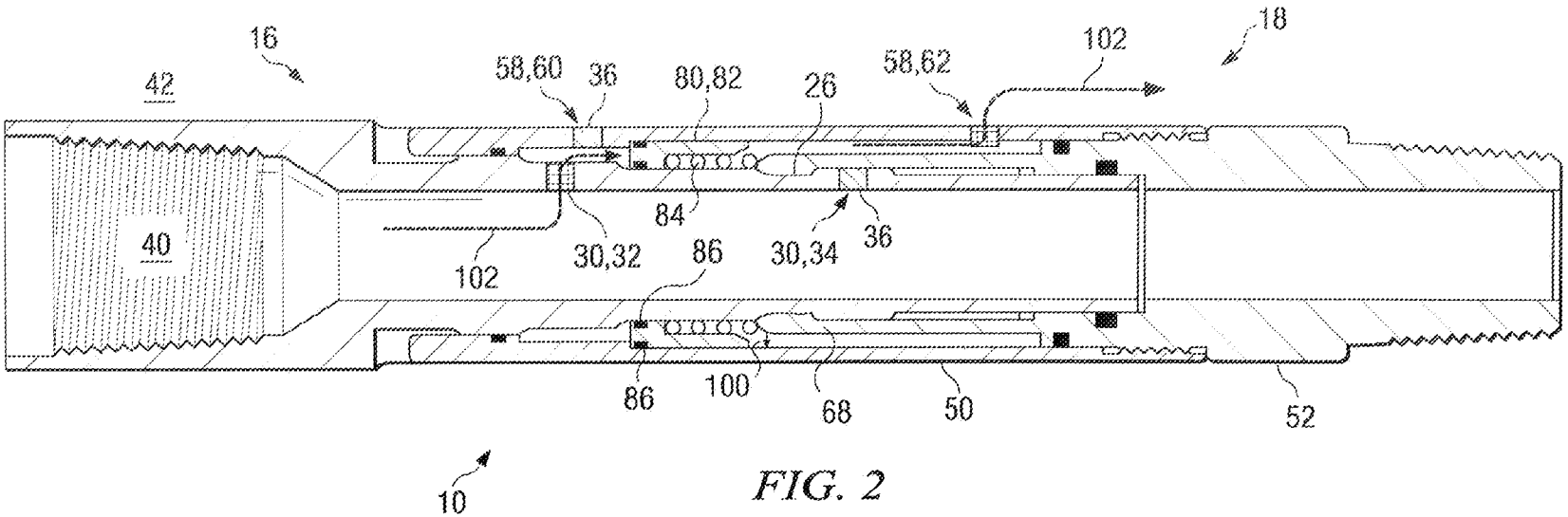
FIG. 2 is a cross-sectional view of the release tool of FIG. 1 with the upper and lower subassemblies connected.

FIG. 2 illustrates the downhole release tool 10 with the upper subassembly 16 connected to the lower subassembly 18. As previously described, the lower subassembly 18 may comprise a fishneck subassembly 50 and a bottom subassembly 52. Collet fingers 68 extend from the bottom subassembly 52 to and are received by groove 26 in upper subassembly 16. Floating piston 82 is disposed between the outer diameter of the upper subassembly 16 and the inner diameter of the fishneck subassembly 50. Spring 84 biases floating piston 82 in a disengaged position. In this position, collet fingers 68 are free to move outwardly in release movement 100.

In operation, one of the upper subassembly equalizing vent ports 30 and one of the lower subassembly equalizing vent ports 58 are closed with plug 36 with the remaining set open. As used herein, each means each of at least a subset of the identified items. For example, in downhole well operations where fluid is pumped down the coiled tubing into the interior 40 of the downhole release tool 10, first upper subassembly vent port 32 and second lower subassembly vent port 62 may be open. In this embodiment, in response to a pressure differential between an interior 40 and exterior 42 of the downhole release tool 10, pressure and/or fluid 102 flows from the interior 40 through the first upper subassembly vent port 32 down onto floating piston 82. Fluid 102 behind the piston may flow out second lower subassembly vent port 62 as the floating piston travels down against the spring 84. As used herein, in response to means in response to at least the identified event. Thus, additional, intermediate or other events may occur or also be required.

The pressure forces the floating piston 82 down against the spring 84 which causes the skirt 83 on the lower end of the floating piston 82 to slide down and encircle the collet fingers 68. This blocks the release movement 100 of the collet fingers 68 and keeps the collet fingers 68 from being pulled out of the groove 26. As a result, the downhole release tool 10 is, in this embodiment, firmly locked, which may prevent the tool from accidentally being pulled and/or pumped apart.

The pressure differential required to overcome the force of spring 84 and engage the floating piston 82 may be configured by controlling the force of spring 84. For example, the spring 84 and floating piston 82 may be configured such that the floating piston 82 engages whenever pumping starts and/or continues at a pressure greater or equal to 20 psi. In this embodiment, whenever pumping stops, the pressure in the interior 40 and the exterior 42 of the downhole release tool 10 may equalize to a differential of less than 20 psi and the floating piston 82 be pushed back by the spring 84 to disengage and allow release of the collet fingers 68 and thus the lower subassembly 18 from the upper subassembly 16 in response to a parting force. Thus, if an emergency release is needed, for example in response to a stuck downhole tool, a straight, or shear pull can be applied to the downhole release tool 10 via the coiled or other tubing and the shear pins sheared. The collet fingers 68 are then forced apart and the upper subassembly 16 and coiled tubing removed from the well.

For downhole well operations in which fluid is pumped through the well annulus on the exterior 42 of the downhole release tool 10, second upper subassembly vent port 34 and first lower subassembly vent port 60 may be open with the remaining ports plugged. In this embodiment, pressure and/or fluid may flow from the exterior 42 of the downhole release tool 10 through the first lower subassembly vent port 60 to act on floating piston 82 and into the interior 40 of the downhole release tool 10 through second upper subassembly vent port 34. As described above, the pressure forces the floating piston 82 down against the spring 84 and the skirt 83 on the lower end of the floating piston 82 over collet fingers 68. Other suitable downhole conditions may be used to act on or otherwise move floating piston 82 or other release guard 80. Thus, pressure and/or fluid flow may otherwise suitably actuate and/or otherwise selectively control engagement and disengagement of release guard 80.

Figure 3:
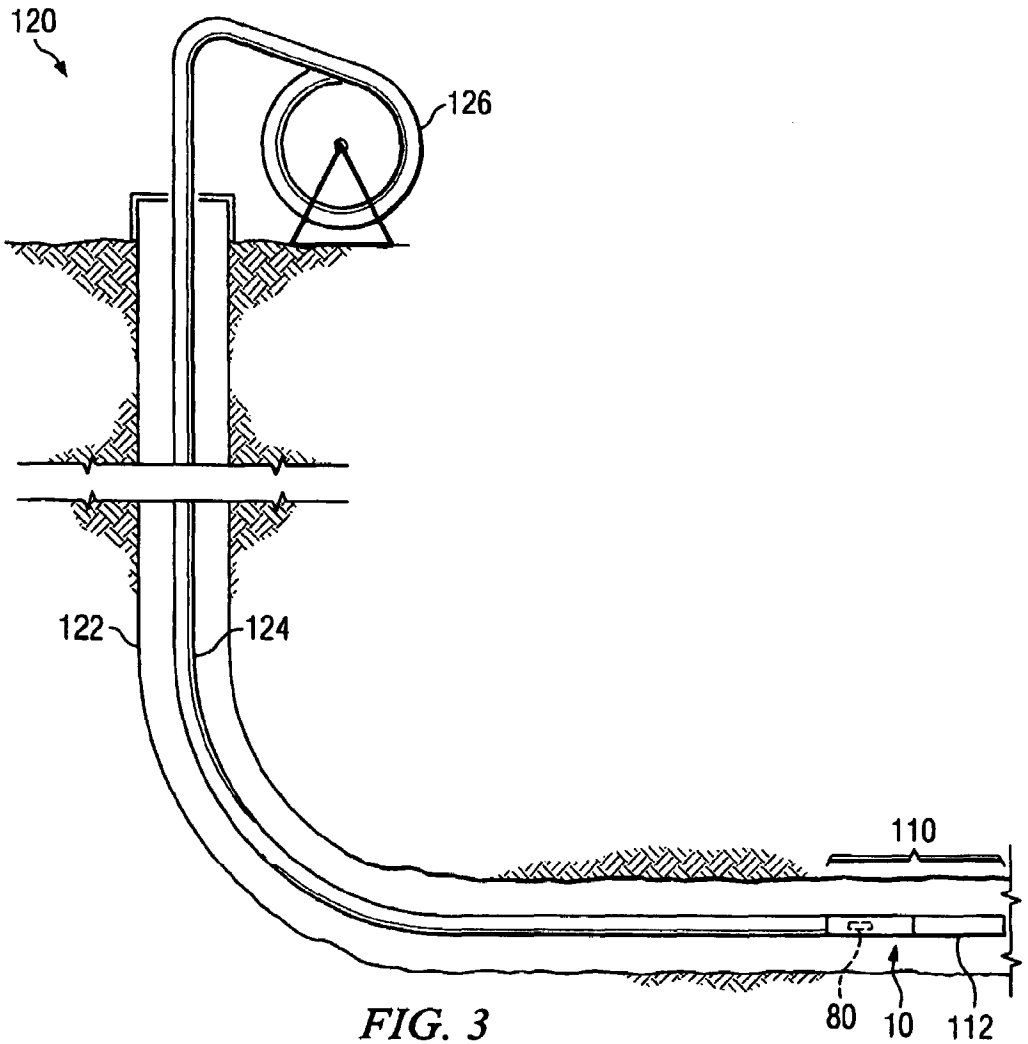
FIG. 3 is a cross-sectional view, not necessarily to scale, illustrating one embodiment of use of a bottom hole assembly (BHA) including the release tool of FIG. 1.

FIG. 3 illustrates use of the downhole release tool 10 as part of a bottom hole assembly (BHA) 110. In this embodiment, BHA 110 includes downhole tool 112 connected or otherwise coupled to a lower end of the downhole release tool 10. The downhole tool 112 may comprise a fracture tool such as a SURGIFRAC tool manufactured by HALLIBURTON or a COBRAFRAC tool manufactured by HALLIBURTON. In other embodiments, the downhole tool 112 may comprise a perforating tool, an acidizing tool, a cementing tool, a logging tool, a production enhancement tool, a completion tool or any other tool capable of being coupled to the downhole release tool 10 and performing a downhole well operation.

Referring to FIG. 3, well 120 includes a wellbore 122. The BHA 110 is lowered into the wellbore 122 at an end of coiled tubing 124. The coiled tubing 124 is inserted and removed from the wellbore 122 by coiled tubing unit 126. The coiled tubing unit 126 includes a coiled tubing injector that inserts and retrieves the coiled tubing 124. The coiled tubing 124 and coiled tubing injector may each be rated to a specified pull limit. As previously described, other suitable types of tubing and surface equipment may be used.

In operation, fluid is pumped to the BHA 110 through coiled tubing 124 by coiled tubing unit 126. During pumping, the release guard 80 engages to lock the downhole release tool 10 and prevent or at least inhibit the downhole tool 112 from being accidentally pumped or pulled apart from coiled tubing 124. If downhole tool 112 becomes stuck in wellbore 122, pumping by coiled tubing unit 126 may be terminated to allow pressure within BHA 110 to equalize. In response to pressure equalization, the release guard 80 disengages to unlock the downhole release tool 10. Coiled tubing unit 126 may then pull on the coiled tubing 124 and thus the downhole release tool 10 to separate from the stuck downhole tool 112. As previously described, the parting force for separating the coiled tubing 124 from the downhole tool 112 may be less than 25,000 pounds. Accordingly, in this embodiment, large coiled tubing units 126 need not be deployed. Rather, the smaller coiled tubing units 126 capable of pulling, based on limits of the coiled tubing and the coiled tubing injector, 40,000 pounds or less may instead be used.

Figure 4:
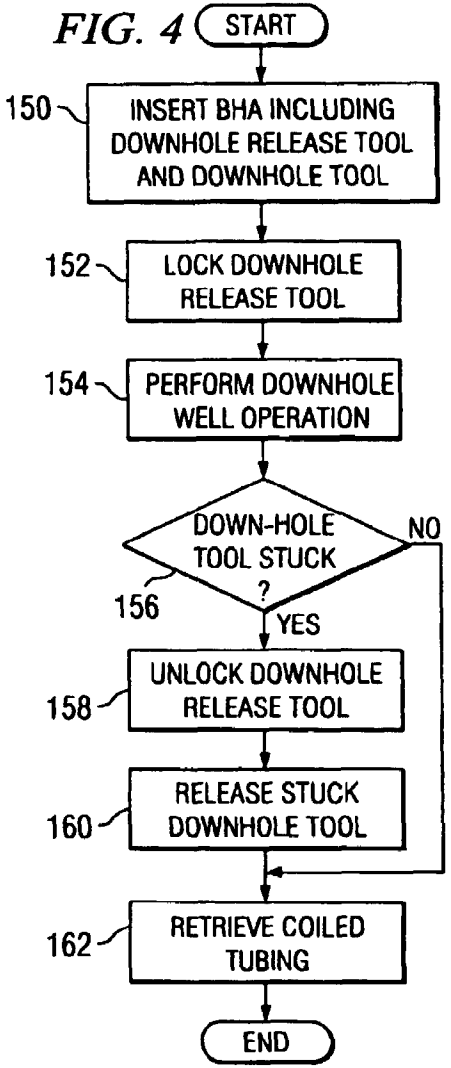
FIG. 4 is a flow diagram illustrating one embodiment of a method for performing a downhole well operation with a BHA including a downhole release tool.

FIG. 4 illustrates one embodiment of a method performing a downhole well operation with a BHA 110 including a downhole release tool 10. Referring to FIG. 4, the method begins at step 150 in which BHA 110 is inserted into a wellbore 122 with coiled tubing 124. The BHA 110 includes the downhole release tool 10 and downhole tool 112.

Proceeding to step 152, the downhole release tool 10 is locked. In a particular embodiment, the downhole release tool 10 may be locked by moving release guard 80 to block release movement 100 of the connector of the downhole release tool 10. As previously described, release may be otherwise inhibited by preventing, blocking, restricting, limiting, restraining or interfering with release of a connector of the downhole release tool 10.

At step 154, a downhole well operation is performed. The downhole well operation may comprise a well completion or service operation. In a particular embodiment, the downhole well operation may be a downhole fracture operation in which sand-laden slurry is pumped down the coiled tubing 124 or down an annulus outside the coiled tubing 124 for fracturing a subterranean formation. The downhole release tool 10 may remain locked during the downhole well operation in response to continued pumping.

At decisional step 156, if the downhole tool 112 becomes stuck in the wellbore 122, the Yes branch leads to step 158. At step 158, the downhole release tool 10 is unlocked. In a particular embodiment, the downhole release tool 10 may be unlocked by moving the release guard 80 out of locking position to allow release movement 100 of the connector of the downhole release tool 10. The release guard 80 may be moved out of locking position by stopping pumping and allowing downhole pressure to equalize between an interior 40 and exterior 42 of the downhole release tool 10. As previously described, release may be otherwise uninhibited to unlock the downhole release tool 10.

At step 160, the stuck downhole tool 112 is separated by pulling on the coiled tubing 124 at the surface with the coiled tubing unit 126. The parting force may comprise approximately 25,000 pounds or other suitable shear force. Next, at step 162, the coiled tubing 124 is retrieved with the coiled tubing unit 126.

Returning to decisional step 156, if the downhole tool 112 is not stuck, the No branch leads to step 162 in which the coiled tubing 124 is retrieved. In this case, the coiled tubing 124 is retrieved with the complete BHA 110. Accordingly, release of the downhole tool 112 may be selectively inhibited through pumping, downhole pressure or other suitable operations and/or conditions to limit or prevent accidental tool release.

A number of embodiments of the downhole release tool have been described. Nevertheless, it will be understood that various modifications may be made without departing from the spirit and scope of the disclosure. Accordingly, other embodiments are within the scope of the following claims.

What is claimed is:

1. A release tool, comprising:

a first subassembly;

a second subassembly;

a connector operable to selectively couple the first subassembly to the second subassembly; and a release guard operable to selectively inhibit release of the connector, the release guard operable to release the connector at a parting force of less than a coiled tubing and coiled tubing injector limit at a first downhole pressure condition comprising an equalized pressure between an interior of the release tool and an exterior of the release tool and to inhibit release of the connector to a parting force greater than the coiled tubing and coiled tubing injector limit in response to a second downhole pressure condition comprising a pressure difference between an interior of the release tool and an exterior of the release tool.

2. The release tool of claim 1, the release guard operable to prevent release of the connector.

3. The release tool of claim 1, wherein the first subassembly comprises an upper subassembly and the second subassembly comprises a lower subassembly.

4. The release tool of claim 3, the lower subassembly comprising an internal fishneck.

5. The release tool of claim 1, wherein the release guard is operable to inhibit release of the connector by blocking release movement of the connector.

6. The release tool of claim 1, wherein the release guard is biased to allow release movement of the connector and moveable to inhibit release of the connection.

7. The release tool of claim 1, wherein the pressure difference comprises a pressure difference generated by pumping a fluid downhole.

8. The release tool of claim 1, wherein the release guard is biased to allow release of the connector in response to an equalized pressure between the interior of the release tool and an exterior of the release tool.

9. The release tool of claim 1, wherein the release guard comprises a floating piston.

10. The release tool of claim 1, the connector comprising at least one protuberance on the first subassembly and a corresponding receiver for the protuberance on the second subassembly.

11. The release tool of claim 1, the connector comprising a plurality of collet fingers on the first subassembly and a corresponding groove on the second subassembly.

12. The release tool of claim 11, wherein the first subassembly comprises an upper subassembly and the second subassembly comprises a lower subassembly.

13. The release tool of claim 1, further comprising a second connector including one or more shear pins.

14. The release tool of claim 1, wherein the release guard is operable to selectively allow release of the connector and, when the release guard allows release of the connector, the connector is separable by a shear force.

15. The release tool of claim 1, further comprising a shear pin coupling the first subassembly to the second subassembly.

16. The release tool of claim 1, further comprising:

a plurality of vent ports operable to communicate pressure between an interior of the release tool and an exterior of the release tool.

17. A bottom hole assembly (BHA), comprising:

a release tool comprising a release guard operable to selectively inhibit release of a connector of the release tool, the release guard operable to release the connector at a parting force of less than a coiled tubing and coiled tubing injector limit at a first downhole pressure condition comprising an equalized pressure between an interior of the release tool and an exterior of the release tool and to inhibit release of the connector to a parting force greater than the coiled tubing and coiled tubing injector limit at a second downhole pressure condition comprising a pressure differential between an interior of the release tool and an exterior of the release tool; and a tool coupled to the release tool for performing a downhole well operation.

18. The BHA of claim 17, wherein the downhole tool comprises a fracture tool.

19. The BHA of claim 18, wherein the release guard is operable to inhibit release of the connector during a fracture operation.

20. The BHA of claim 17, wherein the release guard is operable to inhibit release of the connector based on a greater pressure in an interior of the release tool than about an exterior of the release tool.

21. The BHA of claim 17, wherein the release guard is operable to block release movement of the connector.

22. The BHA of claim 17, wherein the connector comprises a plurality of collet fingers and a corresponding groove.

23. The BHA of claim 22, wherein release guard is operable to encircle the collet fingers to inhibit release of the connector.

24. A downhole release tool, comprising:

a lower subassembly;

an upper subassembly;

a plurality of collet fingers extending from the lower subassembly;

a groove in the upper subassembly configured to receive the collet fingers;

a floating piston biased upwardly by a spring captured between the floating piston and ends of the collet fingers;

equalizing vent ports in the first subassembly and the second subassembly operable to allow pressure to act on the floating piston; and wherein the lower and upper subassemblies have a parting force less than a coiled tubing and coiled tubing injector limit at a first downhole pressure condition comprising an equalized pressure between an interior of the release tool and an exterior of the release tool and wherein the piston moves downwardly in response to a pressure condition comprising a pressure difference between the interior of the release tool and the exterior of the release tool to encircle the collet fingers and prevent the collet fingers from being pulled out of the corresponding groove of the upper subassembly and thereby provide a parting force greater than the coiled tubing and coiled tubing injector limit.

25. The downhole release tool of claim 24, further comprising one or more shear pins coupling the first subassembly to the second subassembly.

26. A release tool, comprising:

a tool assembly operable to separate by a parting force of less than a coiled tubing and coiled tubing injector limit at a first downhole pressure condition, and to separate by a parting force of greater than the coiled tubing and coiled tubing injector limit at a second downhole pressure condition, wherein the first downhole pressure condition comprises an equalized pressure between an interior of the release tool and an exterior of the release tool, and wherein the second downhole pressure condition comprises a pressure difference between the interior of the release tool and the exterior of the release tool.

27. The release tool of claim 26, wherein:

the second downhole pressure condition comprises a greater pressure in the interior of the release tool than about the exterior of the release tool.

28. A method for releasing tubing from a downhole tool, comprising:

terminating pumping of fluids downhole from the surface to disengage a release guard; and pulling a tubing from the surface to separate the tubing from a downhole tool, wherein the release guard is operable to inhibit separation of the tubing from the downhole tool by selectively changing a parting force from less than a coiled tubing and coiled tubing injector limit at a first downhole pressure condition comprising an equalized pressure between an interior of the downhole tool and an exterior of the downhole tool to a parting force greater than the coiled tubing and coiled tubing injector limit at a second downhole pressure condition comprising a pressure difference between the interior of the downhole tool and the exterior of the downhole tool.

29. The method of claim 28, wherein the tubing comprises coiled tubing.

30. The method of claim 28, wherein the release guard inhibits separation of the tubing from the downhole tool by preventing release movement of a connector coupling the tubing to the downhole tool.

31. A method for performing a downhole operation with a bottom hole assembly (BHA), comprising:

during pumping of fluids downhole for a downhole well operation, inhibiting release of a connector coupling a downhole tool to tubing for the downhole well operation in response to a pressure differential between an interior and an exterior of the connector; the pressure differential operable to change a parting force from less than a coiled tubing and coiled tubing injector limit at a first downhole pressure condition comprising an equalized pressure between an interior of the downhole tool and an exterior of the downhole tool to a parting force greater than the coiled tubing, and coiled tubing injector limit at a second downhole pressure condition comprising a pressure difference between the interior of the downhole tool and the exterior of the downhole tool; and using the fluids to perform the downhole operation with the downhole tool.

32. The method of claim 31, wherein the downhole well operation comprises a fracture operation.

* * * * *